US005195666A

United States Patent [19]

Yamaguchi et al.

[11] Patent Number: 5,195,666

[45] Date of Patent: Mar. 23, 1993

[54] WAIST BAG

[76] Inventors: Sumiko Yamaguchi; Takumichi Yamaguchi, both of 16-32-103 Sengen Uemachi; Keiko Hirasawa, 1221-1 Matsuoka, all of Fuji-shi, Shizuoka-ken, Japan

[21] Appl. No.: 654,888

[22] Filed: Feb. 13, 1991

[30] Foreign Application Priority Data

Oct. 8, 1990 [JP] Japan ..... 2-105238

[51] Int. Cl.[5] ..... A45F 4/02

[52] U.S. Cl. ..... 224/159; 224/208

[58] Field of Search ..... 224/158-161, 224/202, 205, 208, 204, 206, 224, 227, 235, 257, 258, 259, 262

[56] References Cited

U.S. PATENT DOCUMENTS

| | | | |
|---|---|---|---|
| 215,399 | 5/1879 | Schaefer et al. | 224/208 |
| 1,292,728 | 1/1919 | Dozier | 224/208 |
| 1,575,875 | 3/1926 | Szewczyk | 224/202 X |
| 2,855,133 | 10/1958 | Mullin | 224/259 X |
| 2,996,228 | 8/1961 | Bauman | 224/259 X |
| 3,001,566 | 9/1961 | Lipsitz | 224/202 |
| 4,068,786 | 1/1978 | Taniguchi | 224/159 X |
| 4,287,971 | 9/1981 | Doulet | 224/206 |
| 4,518,107 | 5/1985 | Amos | 224/215 |
| 4,746,044 | 5/1988 | Arvizu et al. | 224/161 |
| 4,878,606 | 11/1989 | Miller | 224/208 |
| 4,887,751 | 12/1989 | Lehman | 224/205 X |
| 4,923,104 | 5/1990 | Rice et al. | 224/160 X |

FOREIGN PATENT DOCUMENTS

| | | | |
|---|---|---|---|
| 809583 | 7/1951 | Fed. Rep. of Germany . | |
| 2404414 | 6/1979 | France | 224/160 |
| 0585378 | 2/1947 | United Kingdom | 224/159 |
| 2201083 | 8/1988 | United Kingdom . | |

*Primary Examiner*—Henry J. Recla
*Assistant Examiner*—Casey Jacyna
*Attorney, Agent, or Firm*—Oblon, Spivak, McClelland, Maier & Neustadt

[57] ABSTRACT

A waist bag includes a bag body, a length-adjustable waist belt connected to the bag body and a shoulder strap connected to the bag body for suspending the bag body from the neck or shoulder of a user. The top surface of the bag body is reinforced with a plate core. The bag body is formed therein with a first receptacle for small articles and a second receptacle for the shoulder strap.

2 Claims, 7 Drawing Sheets

WAIST BAG

BACKGROUND OF THE INVENTION

1. Field of the Invention

The present invention relates to a waist bag to which a length adjustable waist belt is joined at the opposite ends of the bag body.

2. Description of the Prior Art

A waist bag can hold small articles such as a purse and a handkerchief and is worn around the waist of a user. Its use has become popular among motorcyclists and those going on outings and pleasure trips as it allows the wearer to use both hands freely. However, the conventional waist bags can be used only for a container for such small articles.

An object of the present invention is to provide a waist bag capable of helping the user hold a baby in his or her arms.

SUMMARY OF THE INVENTION

To accomplish the above object, according to the present invention there is provided a waist bag comprising a bag body, a plate core with which the top of the bag body is reinforced from the inside thereof, and a shoulder strap attached to the bag body for suspending the bag body from the neck or shoulder, the bag body having a first receptacle for small articles and a second receptacle for the shoulder strap.

Therefore, in the case where it becomes necessary for a user of the waist bag of the present invention to hold a baby in his or her arms during an outing, it is possible to use the waist bag for this purpose by taking the shoulder strap out of the second receptacle, suspending it from the neck or shoulder and seating the baby on the bag body. Since the top of the bag body is reinforced with the plate core, the baby can stably sit on the top of the bag body safely and, even in this state, it is possible to easily take small articles in and out of the first receptacle of the bag body. Further, when it becomes unnecessary to hold the baby in the arms, the shoulder strap may be stored in the second receptacle of the bag body. Thus, the appearance of the waist bag of the present invention becomes similar to that of an ordinary waist bag. The waist bag of the present invention is of good style and is easy to carry and requires no separate equipment for holding a baby in user's arms. It is thus very convenient.

The above and other objects, characteristic features and advantages of the present invention will become more apparent from the detailed description to be given hereinbelow with reference to the accompanying drawings.

DETAILED DESCRIPTION OF THE PREFERRED EMBODIMENTS

Figure 1:
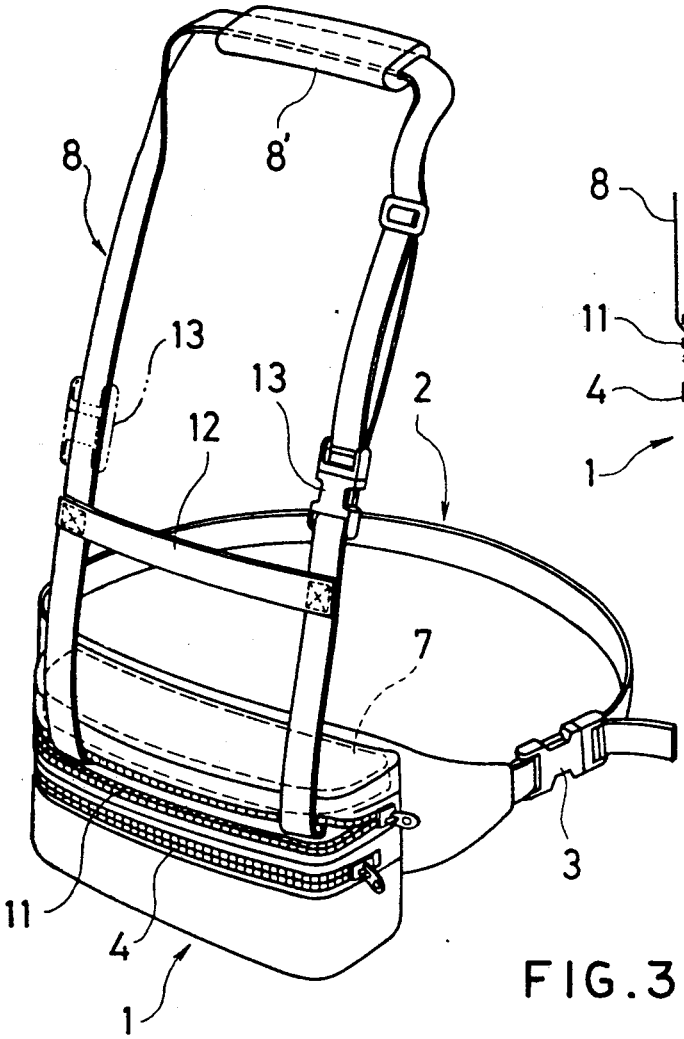
FIG. 1 is a perspective view showing the first embodiment of the waist bag according to the invention, with a shoulder strap taken out of a second receptacle.

In each embodiment of the waist bag shown in the drawings, reference numeral 1 designates a bag body and numeral 2 a waist belt joined to the bag body 1 at the opposite ends thereof. The waist belt 2 is provided midway the length thereof with a buckle 3 having a length adjuster capable of adjusting the length of the belt 2. The belt 2 can be separated at the midway portion to facilitate attachment and detachment of the belt 2 relative to the waist. The bag body 1 is provided therein with a first receptacle 5 for small articles such as a purse and a handkerchief. The first receptacle 5 is like the container of a conventional waist bag and has an opening that is opened and closed by an opening and shutting device 4 such as a slide fastener so that small articles can be inserted into or taken out of the first receptacle 5. The inside of the bag body 1 above the first receptacle 5 is partitioned with a piece of cloth 6 into a plate core accommodating space 6' and a second receptacle 9. A plate core 7 of substantially the same size as the top face of the bag body 1 and made from foamed polyethylene or other suitable material is accommodated in the space 6' to reinforce the top face of the bag body 1 from the inside thereof. A shoulder strap 8 is used for suspending the bag body 1 from the neck or shoulder and is adjustable in its length, and may be provided with a shoulder pad 8' movable along the length thereof, if desired. The first receptacle 5 for small articles and the second receptacle 9 for storing the shoulder strap 8 are partitioned with a piece of cloth 10. The second receptacle 9 can be opened and closed with an opening and shutting device 11 such as a slide fastener. The two opening and shutting devices 4 and 11 are located on the front side of the bag body 1.

Figure 2:
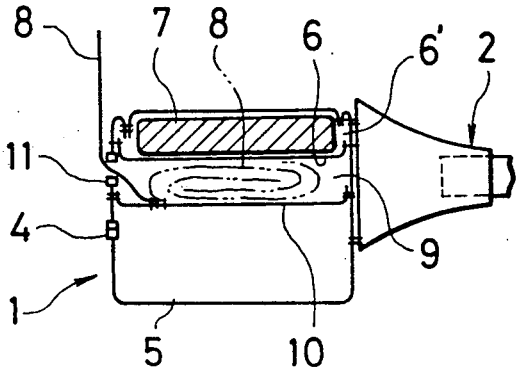
FIG. 2 is a schematic sectional view showing the principal part of the waist bag of FIG. 1.

In the first embodiment of FIG. 1, the shoulder strap 8 consists of a single elongated strap with the oposite ends sewed to the aforementioned cloth 6 or 10 and, when the shoulder strap 8 is not used, it is stored in the second receptacle 9 as shown by the phantom line in FIG. 2.

Figure 3:
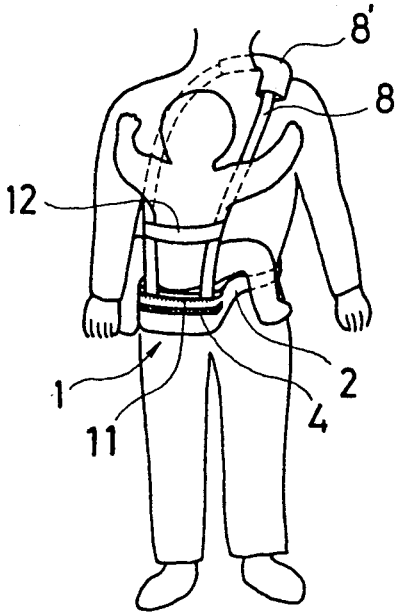
FIG. 3 is an explanatory view showing how the user utilizes the waist bag of FIG. 1 for holding a baby.

Thus, the waist bag of the present invention can be used in the same manner as in the case of the conventional waist bags and, when it becomes necessary for the user to hold a baby in his or her arms during an outing, for example, he or she can use the waist bag for this purpose by opening the opening and shutting device 11, taking the shoulder strap 8 out of the second receptacle 9, suspending the shoulder strap 8 from the neck or shoulder, and seating the baby on the top of the bag body 1 reinforced with the plate core 7 so that the baby faces him or her, thereby receiving the weight of the baby on the neck or shoulder through the shoulder strap 8 as shown in FIG. 3. In this case, since the weight of the baby is also received on the bag body 1, the load exerted on the neck or shoulder can be reduced to prevent stiffness from arising in the shoulders and permit easy holding of the baby. FIG. 3 shows the state wherein the baby faces the chest of the user. This state may be changed by moving the bag body 1 to the right or left side of the user and causing the legs of the baby to straddle the waist of the user.

Furthermore, since the shoulder strap 8 is provided with an auxiliary strap 12 for reclining the back of the baby thereon, the baby can be stably held. In FIG. 1, the auxiliary strap 12 is shown to be sewed to the shoulder strap 8. However, it may be removably connected to the shoulder strap 8 via a connector.

Since the baby sits on the top of the bag body 1 reinforced with the plate core 7 from the inside thereof, there is no fear of the bag body 1 being deformed and, in this state, small articles can be inserted into or taken out of the first receptacle 5 of the bag body 1 with ease.

When the baby is to be carried for only a short distance or to be held for only a short time, it may be held sitting on the top surface of the bag body 1 reinforced from the inside thereof with the plate core 7, with the shoulder strap 8 remaining stored in the second receptacle 9.

One or two male-to-famale buckles 13 capable of separating the shoulder strap 8 may be provided on the shoulder strap 8 so that the separated shoulder strap 8 can be accommodated in the second receptacle 9.

Figure 4:
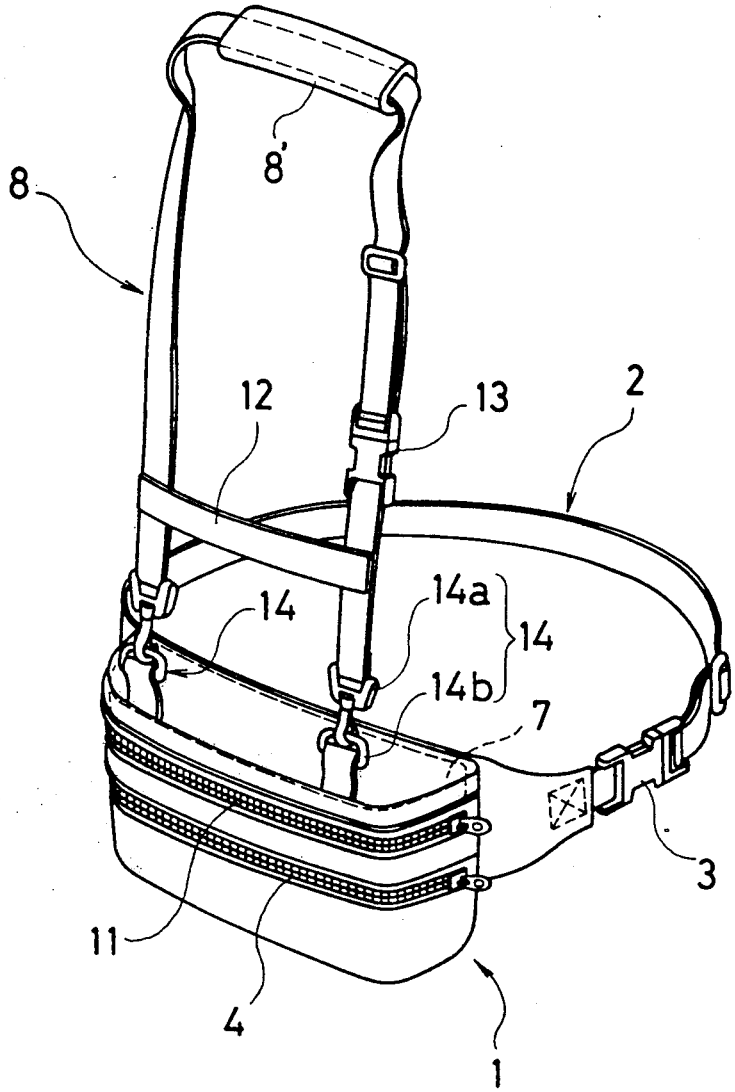
FIG. 4 is a perspective view showing the second embodiment of the waist bag according to the invention.
Figure 5:
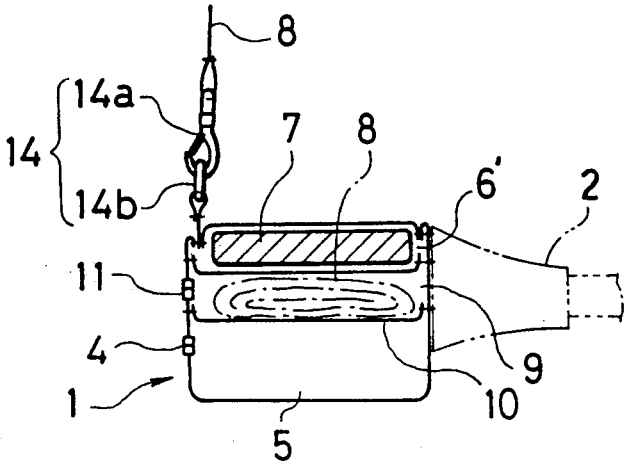
FIG. 5 is a schematic sectional view showing the principal part of the waist bag of FIG. 4.

FIGS. 4 and 5 illustrate the second embodiment of the waist bag according to the present invention. In the second embodiment, a pair of connectors 14 each comprising a loop clutch 14*a* and D-shaped ring 14*b* are used so that the shoulder strap 8 can be attached to and detached from the bag body 1. The loop clutches 14*a* are provided on the opposite ends of the shoulder strap 8 and the D-shaped rings 14*b* are provided on the upper surface of the bag body 1. The D-shaped rings 14*b* are always exposed to the outside of the upper surface of the bag body 1. The connector 14 may comprise a male-to-female fastener in place of the combination of the loop clutch 14*a* and D-shaped ring 14*b*.

The waist bag of the second embodiment can be used concurrently as a baby carrier by taking the shoulder strap 8 out of the second receptacle 9 and connecting the loop clutches 14*a* of the shoulder strap 8 to the D-shaped rings 14*b* of the bag body 1. Thus, the second embodiment facilitates the storage and removal of the shoulder strap 8 in and out of the second receptacle 9.

Figure 6:
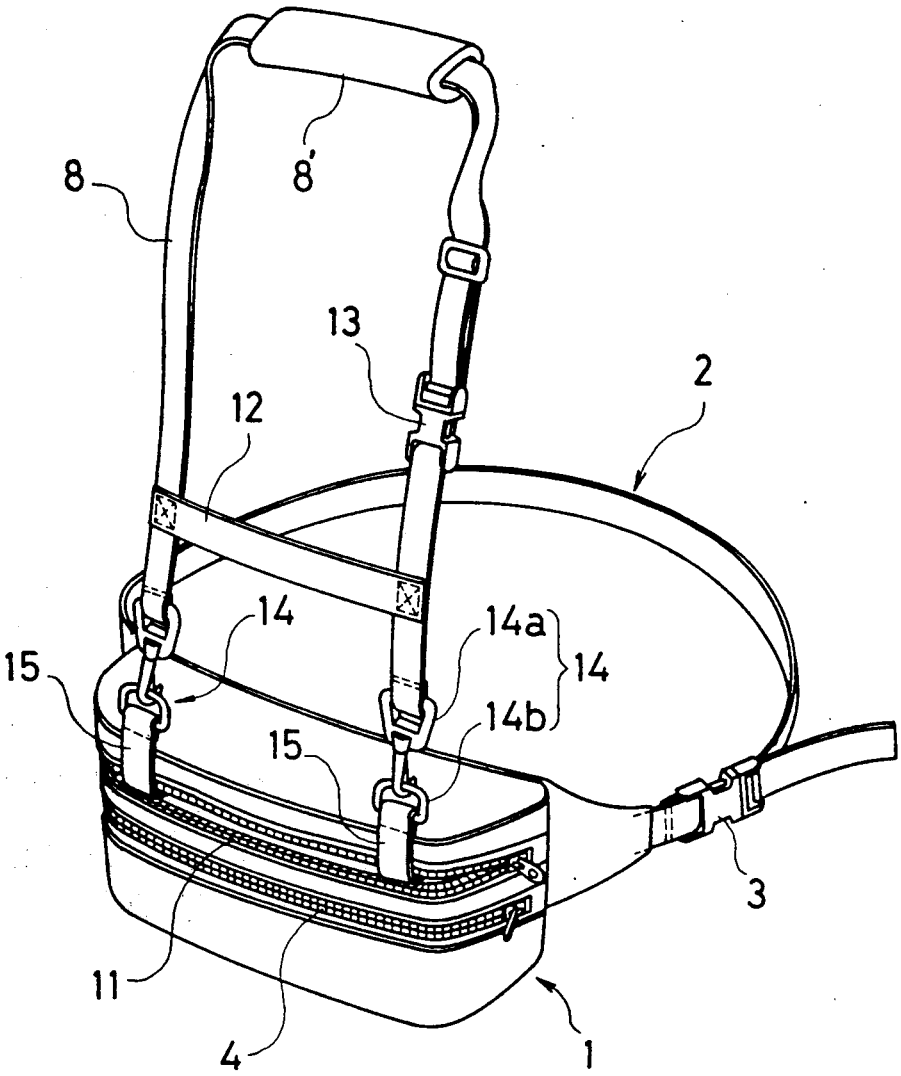
FIG. 6 is a perspective view showing the third embodiment of the waist bag according to the invention.
Figure 7:
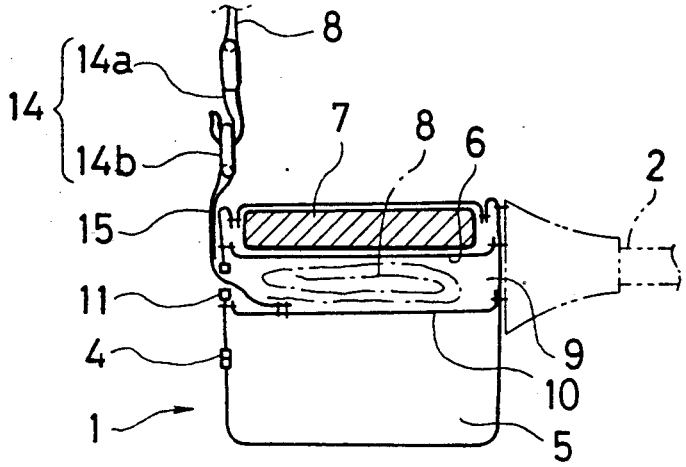
FIG. 7 is a schematic sectional view showing the principal part of the waist bag of FIG. 6.

FIGS. 6 and 7 illustrate the third embodiment of the waist bag according to the present invention, in which the ring 14 is mounted on one end of each of a pair of strap pieces 15 having the other end sewed to the cloth 6 of the bag body 1. Therefore, when the waist bag is not being used as a baby carrier, the strap pieces 15 with the rings 14 may be accommodated in the second receptacle 9 together with the separated shoulder strap 8. Thus, since the rings 14 are not exposed to the outside of the bag body 1 unlike in the second embodiment, the third embodiment can provide a better appearance.

In each of the aforementioned embodiments, the shoulder strap 8 comprises a single elongated strap having the opposite ends sewed to the bag body 1 (FIGS. 1 and 2) or separably connected to the bag body 1 via the connectors 14 (FIGS. 4 and 5 or FIGS. 6 and 7). However, it may comprise a Y-shaped strap having the upper portion 8*a* formed into a loop as shown in FIGS. 8 to 10.

Figure 8:
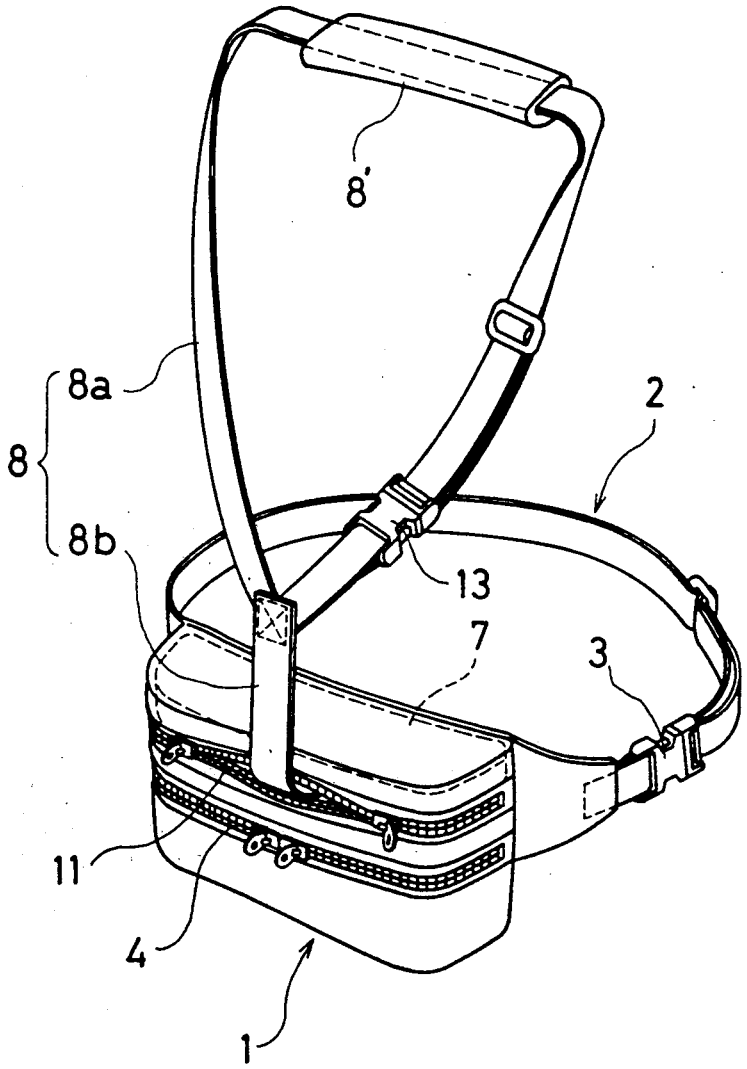
FIG. 8 is a perspective view showing the fourth embodiment of the waist bag according to the invention.

FIG. 8 illustrates the fourth embodiment of the waist bag according to the present invention, in which the upper portion 8*a* of the Y-shaped strap 8 is formed into a loop and the lower portion thereof is sewed to the cloth 6 or 10 (not shown) in the same manner as in the first embodiment shown in FIG. 1.

Figure 9:
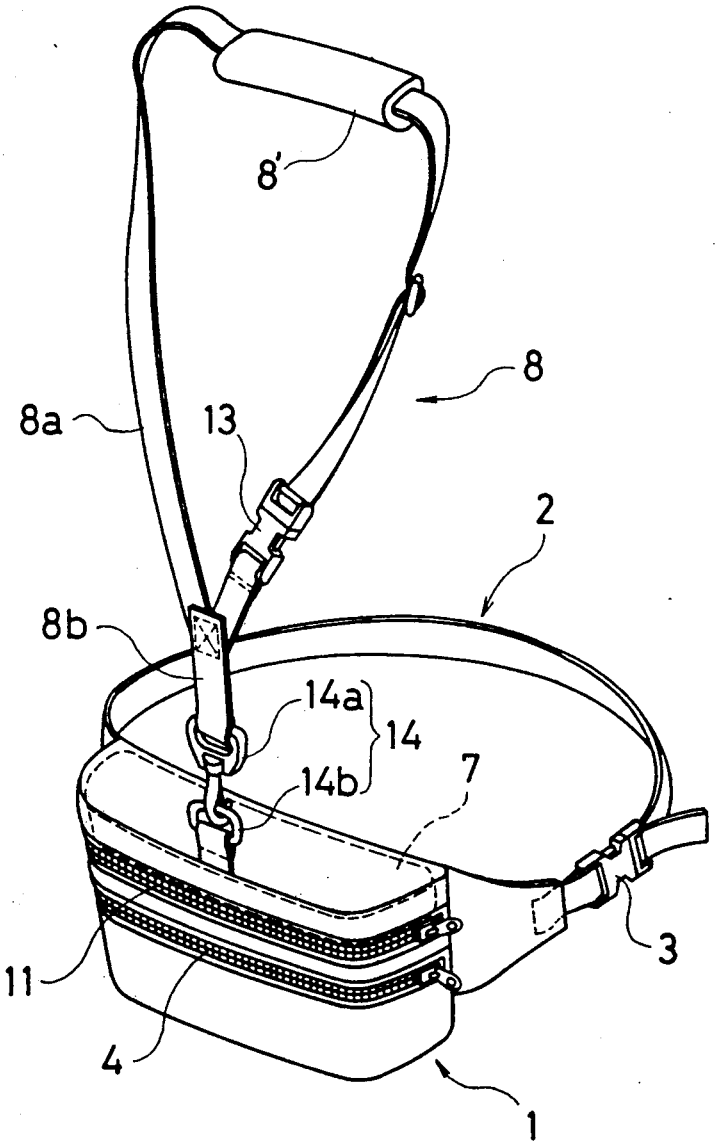
FIG. 9 is a perspective view showing the fifth embodiment of the waist bag according to the invention.

FIG. 9 illustrates the fifth embodiment of the waist bag according to the present invention, in which the lower portion 8*b* of the Y-shaped 8 is provided with a loop clutch 14*a* similarly to the second embodiment shown in FIG. 4 so that the loop clutch 14*a* is separably connected to a ring 14 exposed to the outside of the upper surface of the bag body 1.

Figure 10:
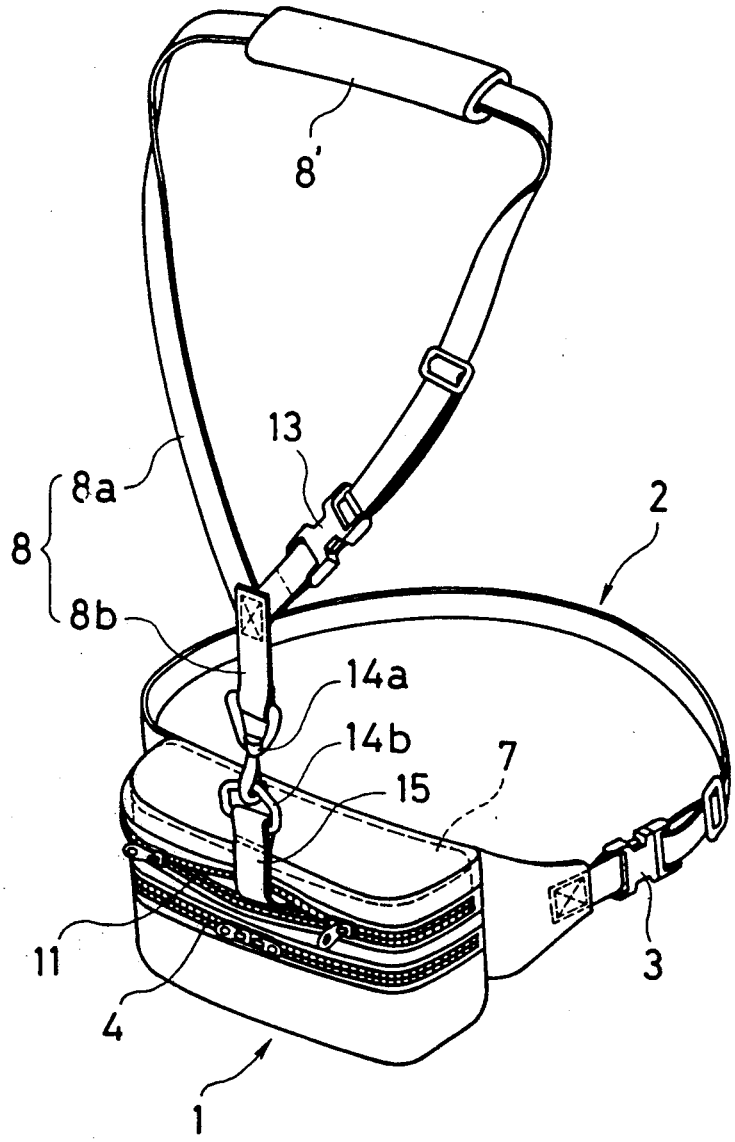
FIG. 10 is a perspective view showing the sixth embodiment of the waist bag according to the invention.

FIG. 10 illustrates the sixth embodiment of the waist bag according to the present invention, in which the lower portion 8*b* of the Y-shaped strap 8 is provided with a loop clutch 14*a* so that the loop clutch 14*a* is separably connected to a ring 14 provided on one end of a strap piece 15 having the other end sewed to the cloth 6 or 10 (not shown).

Figure 11:
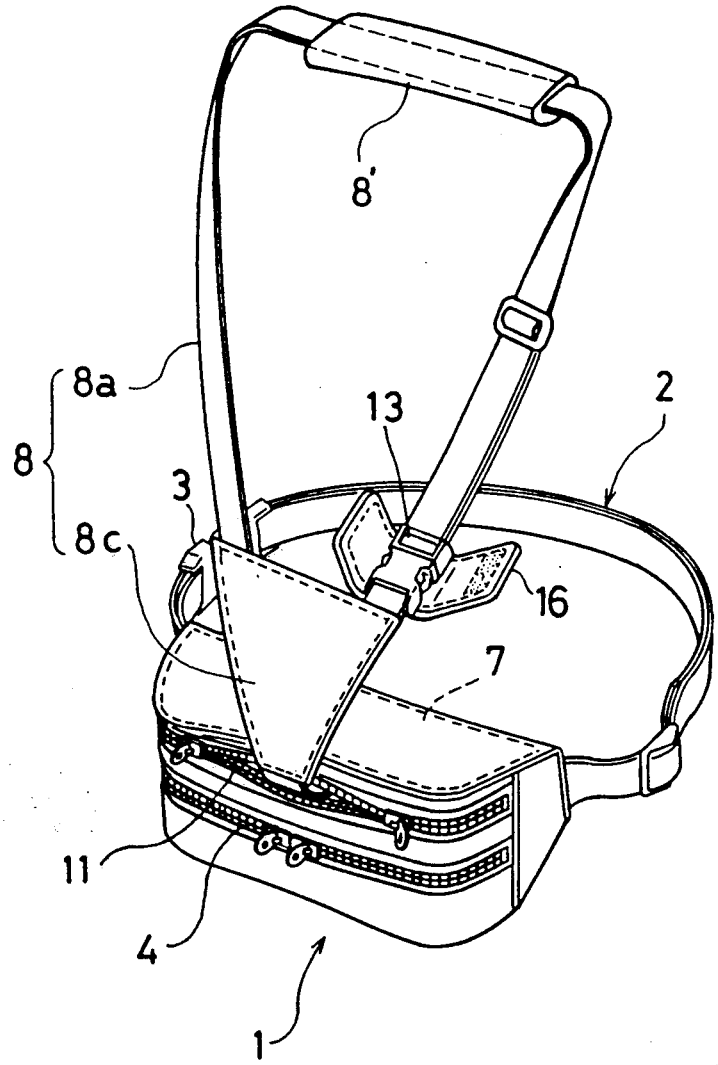
FIG. 11 is a perspective view showing the seventh embodiment of the waist bag according to the invention.

FIG. 11 illustrates the seventh embodiment of the waist bag according to the present invention, in which the shoulder strap 8 comprises an upper portion 8*a* formed into a loop and a reversed triangular piece 8*c* of rigid cloth or leather. A portion of the vertical angle of the reversed triangular piece 8*c* is sewed to the cloth 6 or 10 (not shown) and portions of the base angles of the reversed triangular piece 8*c* are sewed to the opposite ends of the upper portion 8*a* of the shoulder strap. Thus, the reversed triagular piece 8*c* consistutes the lower portion of the shoulder strap 8 and makes it possible to wrap the hips of a baby therein. In the seventh embodiment, therefore, the baby can be stably held without using the auxiliary strap 12 of the first embodiment. Denoted by reference numeral 16 is a protection band for wrapping the buckle 13 therein and protecting the shoulder strap 8 from being separated due to the baby toying with the buckle 13 or any other external force possibly applied to the buckle 13.

As has been described above, the waist bag according to the present invention can be used concurrently as a baby carrier. A user taking a baby outdoors can use the waist bag to hold the baby by taking the shoulder strap out of the second receptacle in the bag body, suspending the shoulder strap from the neck or shoulder and seating the baby on the top of the bag body. It goes without saying that the baby can also be held without using the shoulder strap. Since the top of the bag body is reinforced with the plate core, the baby can be stably held and, in this state, small articles can be inserted into or taken out of the first receptacle in the bag body. Furthermore, when the waist bag is not used as a baby carrier, since the shoulder strap can be stored in the second receptacle so as not to constitute an obstacle, the waist bag is handy to carry.

What is claimed is:

1. A waist bag comprising:

a bag body having a flat top portion;

a plate core with which said flat top portion is reinforced from the inside of said bag body for seating a baby thereon;

a first receptacle formed in said bag body for accommodating small articles therein;

a first opening and shutting device provided at a front side of said bag body for opening and closing said first receptacle;

a length-adjustable waist belt having opposite ends connected to opposite sides of said bag body for supporting said bag body on a user;

a shoulder strap attached to said bag body and having means for supporting the baby from the back when the baby is seated on the bag body, said means including an inverted triangular piece having base angle portions and a apex angle portion;

a second receptacle formed in said bag body and disposed between said plate core and said first receptacle for storing said shoulder strap therein when said shoulder strap is not in use; and a second opening and shutting device provided at the front side of said bag body for opening and closing said second receptacle;

said apex angle portion of said inverted triangular piece being sewed to an inside portion of said second receptacle and said shoulder strap having opposite ends each sewed to a respective one of said base angle portions to give said shoulder strap a loop shape as a whole and provide additional support to said bag body by suspending said bag body from the neck or shoulder of the user.

2. A waist bag comprising:

a bag body having a flat top portion;

a plate core with which said flat top portion is reinforced from the inside of said bag body for seating a baby thereon;

a first receptacle formed in said bag body for accommodating small articles therein;

a first opening and shutting device provided at the front of said bag body for opening and closing said first receptacle;

a length-adjustable waist belt having opposite ends connected to opposite sides of said bag body;

a shoulder strap attached to said bag body for suspending said bag body from the neck or shoulder of a user;

a second receptacle formed in said bag body and disposed between said plate core and said first receptacle for accommodating said shoulder strap therein; and a second opening and shutting device provided at the front of said bag body for opening and closing said second receptacle;

said shoulder strap having opposite ends attached to said bag body by an inverted triangular piece, said inverted triangular piece having base angle portions converging toward an apex portion, said opposite ends being secured to said base angle portions, and said apex angle portion being secured to an inside portion of said second receptacle;

said shoulder strap being accommodated within said second receptacle in the absence of a baby and extracted from said second receptacle in the presence of a baby to wrap the hips of the baby with said inverted triangular piece.

* * * * *